United States Patent [19]

Phalen

[11] Patent Number: 4,602,135

[45] Date of Patent: Jul. 22, 1986

[54] MEMBRANE SWITCH

[76] Inventor: Robert F. Phalen, 1612 W. North Ave., Chicago, Ill. 60622

[21] Appl. No.: 739,544

[22] Filed: May 30, 1985

[51] Int. Cl.[4] ..... H01H 13/70

[52] U.S. Cl. ..... 200/5 A; 200/86 R; 200/159 B

[58] Field of Search ..... 200/5 A, 86 R, 159 B, 200/292, 308

[56] References Cited

U.S. PATENT DOCUMENTS

| | | | |
|---|---|---|---|
| 3,699,294 | 10/1972 | Sudduth | 200/86 R X |
| 4,017,697 | 4/1977 | Larson | 200/5 A |
| 4,085,302 | 4/1978 | Zenk et al. | 200/5 A |
| 4,317,013 | 2/1982 | Larson | 200/5 A |
| 4,365,130 | 12/1982 | Christensen | 200/5 A X |
| 4,385,215 | 5/1983 | Lemberg | 200/5 A |
| 4,471,177 | 9/1984 | Doughty | 200/5 A X |
| 4,525,606 | 6/1985 | Sudo | 200/5 A |

*Primary Examiner*—J. R. Scott

*Attorney, Agent, or Firm*—Robert M. Ward

[57] ABSTRACT

The present invention is directed to an improved membrane switch of the kind comprising a polymeric overlay, which is generally planar and containing designated switch areas thereon for manual operation by pressure. The switch is formed from several layers of conductive and nonconductive materials. Specifically, the switch includes a pair of electronic switch circuit leads disposed in noncontacting proximity. A substantially planar circuit completing layer formed to correspond with the pair of switch circuit leads is formed from conductive material and disposed and spaced array substantially parallel to the switch circuit leads. A nonconductive spacer is disposed, in one preferred embodiment, between the electric circuit and the circuit completing layer, with the spacer having a plurality of apertures therein of a selected density sufficient to provide a selected touch pressure. In another preferred embodiment, the substantially planar circuit completing layer is omitted, and the pair of electronic switch circuit leads are instead disposed in separate planes and are separated by the spacer, such that manual pressure on the switch will contact one circuit lead with the other circuit lead through the apertures in the spacer.

11 Claims, 8 Drawing Figures

MEMBRANE SWITCH

BACKGROUND OF THE INVENTION

The present invention relates generally to switches, and more particularly to an improved membrance switch.

In the prior art, various types of membrane switches have been utilized on machinery panels, calculators, computers, etc. Such membrane switches have the advantage over other forms of switches that they present a substantially flat upper surface, and are relatively very thin as compared with mechanical switches. Also, such membrane switches are enclosed, and contain very few moving parts. Accordingly, such membrane switches have had exceeding long useful lives.

One difficulty with prior art membrane switches has been the inability to control selevtively the amount of pressure necessary to operate this type of switch. Also, another difficulty with prior art switches has been frequently the necessity for switches requiring different manual pressures on the same or different switch panels. Also, the prior switches have had the further difficulty of an inability to provide different operating pressures within the same switch.

Thus, in view of the difficulties and deficiencies with prior art membrane switches, it is an object of the improved membrane switch of the present application to materially alleviate such difficulties and deficiencies.

SUMMARY OF THE INVENTION

The improved membrane switch of the present invention concerns switches having a top sheet with portions designated thereon for manual pushing to operate the switch.

The improved membrane switch of the present invention comprises a pair of electronic switch circuit leads which are disposed in noncontacting and mutually relative proximity. A substantially planar circuit completing means, the size and shape corresponding with at least a portion of the electronic switch circuit leads, is formed from a conductive material and is disposed in spaced array and substantially parallel to the switch circuits.

A spacer means of a nonconductive material is disposed between the pair of electronic circuit leads and the circuit completing means. The spacer means has a plurality of apertures therein of a selected density sufficient to provide a selected touch pressure for pushing portions of the circuit completing means which appear through apertures in the spacer into contact with portions of the pair of electronic switch circuit leads to complete the circuit and to operate the switch.

In an alternative preferred embodiment, the electronic switch circuit leads are disposed in separate planes and substantially parallel to each other and are separated by the spacer means. In such embodiment, the electronic circuit leads are disposed opposite each other, such that sufficient manual pressure on the switch disposes the electronic switch leads into contact with each other through the apertures in the spacer means to operate the swtich. In this embodiment also, the density and location of the apertures controls the amount of pressure necessary to operate the switch.

In both of the above embodiments, the manual pressure necessary to operate the switch may be varied in switches on the same switch panel, or even in portions of the same discrete membrane switch, by varying the size and density of the apertures in the spacer means.

The improved membrane switch of the present invention will be better understood with reference to the following brief description of the drawing, detailed description of preferred embodiments, the appended claims, and the accompanying drawing.

BRIEF DESCRIPTION OF THE DRAWING

Preferred embodiments of the improved membrane switch apparatus of the present invention are set forth in the accompanying drawing, and in which.

DETAILED DESCRIPTION OF THE PREFERRED EMBODIMENTS

The improved membrane switch of the present invention has a top sheet with portions designated by visual indicia thereon for manual pushing to operate the switch. The improved membrane switch of the present invention includes a pair of electronic switch circuit leads which are disposed in noncontacting, and mutually relative proximity. A substantially planar circuit completing means has a size and shape to correspond with at least a portion of the pair of switch circuit leads.

Such circuit completing means is formed from a conductive material, and is disposed in spaced array and substantially parallel to the switch circuits. A spacer means of a nonconductive material is disposed between the pair or electronic circuit leads and the circuit completing means. The spacer means has a plurality of apertures therein of a selected density sufficient to provide a selective touch pressure for pushing portions of the circuit completing means appearing through the apertures and the spacer into contact with portions of the pair of electronic switch circuit leads to complete the circuit and to operate the switch.

The improved membrane switch of the present invention also may include as and for the spacer means a grid formed from lines of a nonconductive material. Such nonconductive material preferably comprises a nonconductive paint, which is disposed on the circuit completing means. Such circuit completing means preferably comprises a conductive paint material, and such conductive paint material is preferably disposed upon a backing sheet.

The nonconductive spacer apertures may be selected to varying density and different portions of the nonconductive spacer, to provide a variable touch pressure at different portions of the nonconductive spacer. The pair of electronic switch circuit leads is preferably disposed in a common plane in preferred embodiments.

In other preferred embodiments, the pair of electronic switch circuit leads are disposed in separate planes, and are disposed substantially parallel to each other and are separated by the spacer means. In this preferred alternative embodiment, the electronic switch circuit leads are disposed opposite each other, whereby sufficient manual pressure on the switch disposes the electronic switch leads into contact through the apertures in the spacer means to operate the switch.

In either of the above embodiments of the improved membrane switch of the present invention, the electronic switch circuits may be preferably formed by printing. Also, the top sheet as for the switch panel comprises a nonconductive polymeric overlay containing visual indicia thereon to define the switch area to be operated by manual pressure.

Figure 1:
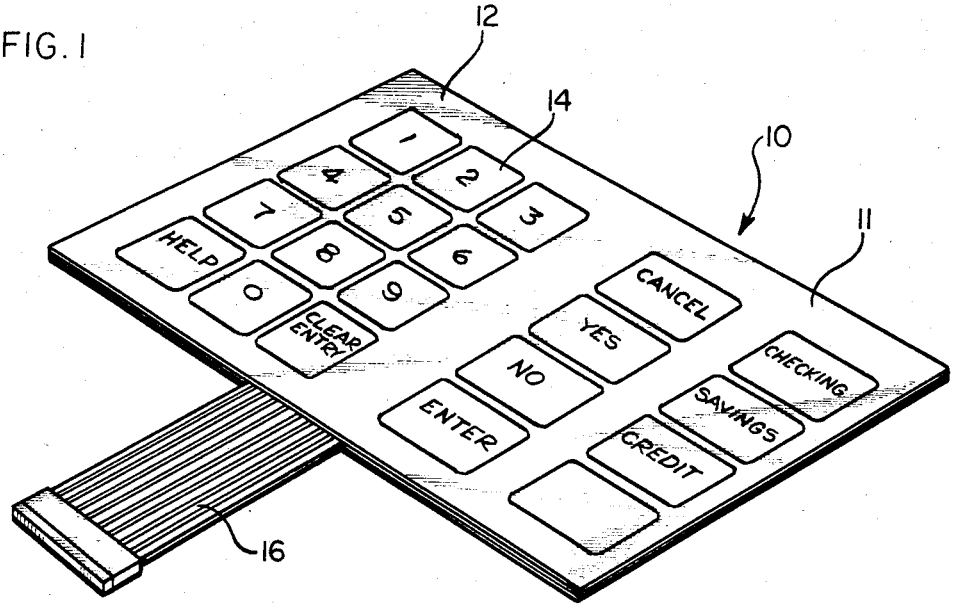
FIG. 1 is a perspective view of an exemplary membrane switch panel setting forth discrete areas containing visual indicia for designating and defining portions of the panel to receive manual pressure for operating an electronic improved membrane switch disposed therebeneath.
Figure 2:
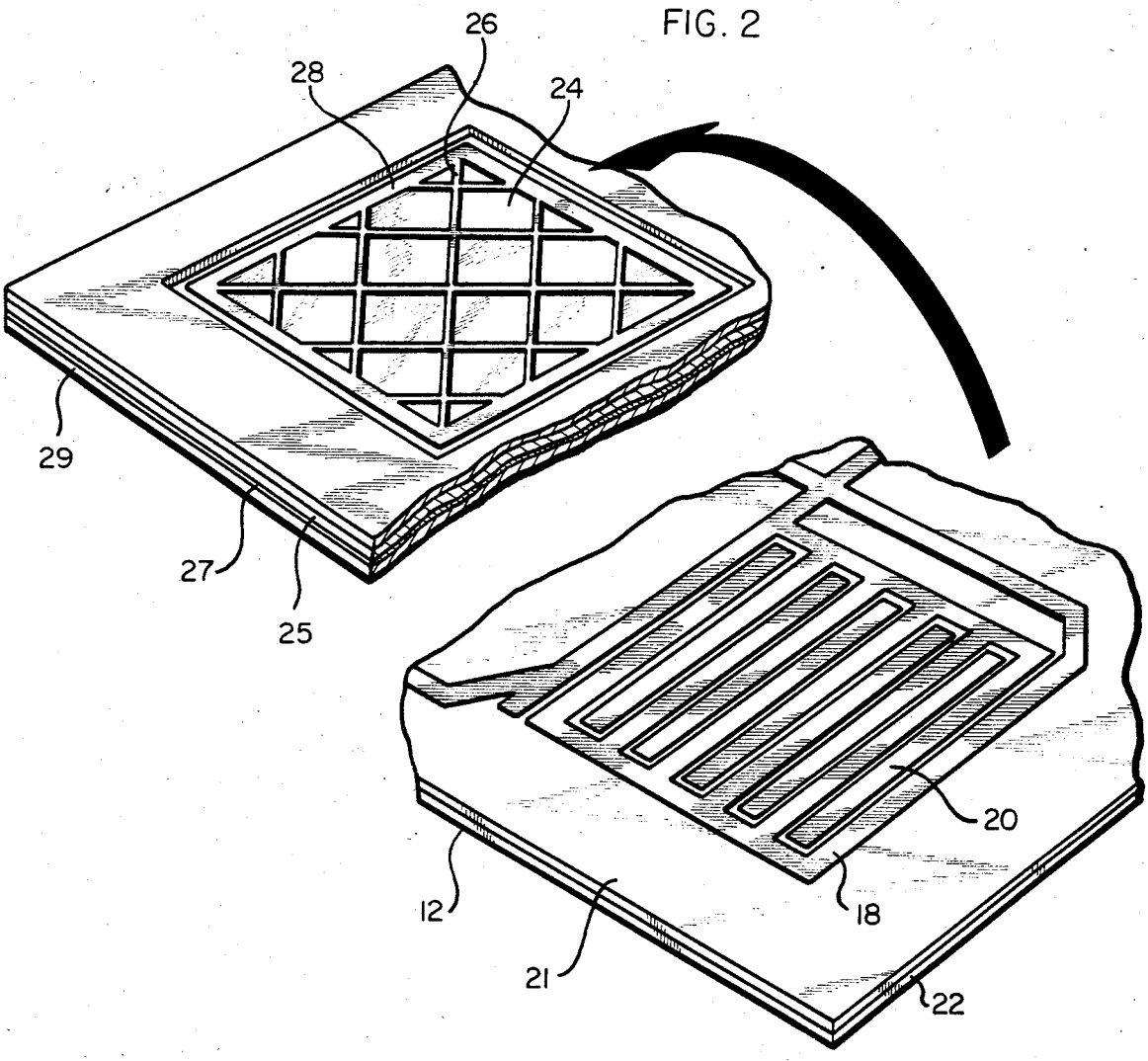
FIG. 2 is a greatly enlarged, fragmented view of the improved membrane switch of the present invention, shown in peeled-apart array, and illustrating the intertwining, but noncontacting, electronic switch circuit leads, and the facing nonconductive, grid-like spacer means disposed atop the substantially planar circuit completing means formed from a conductive material.
Figure 3:
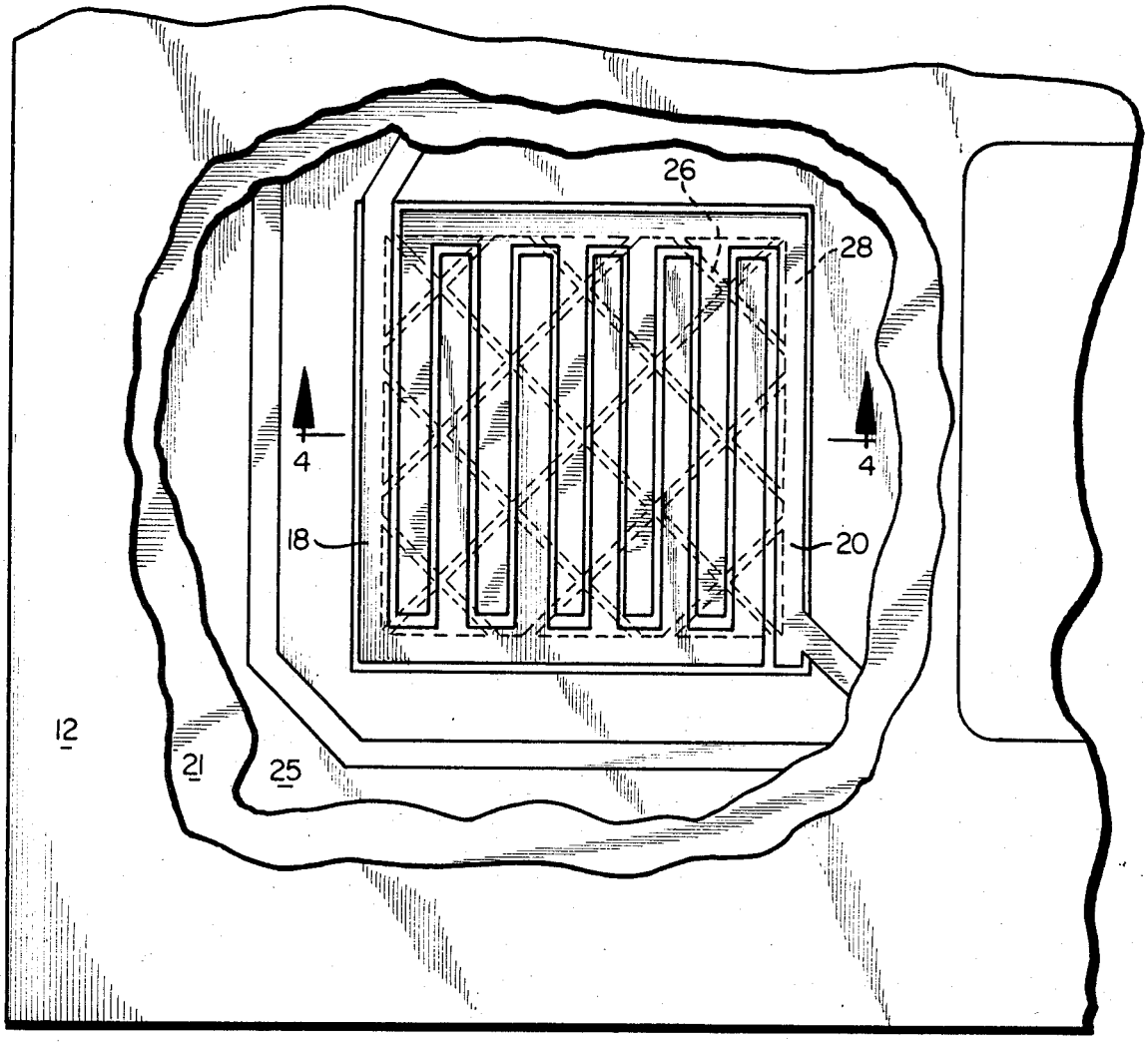
FIG. 3 is a greatly enlarged top view of the improved membrane switch of the present invention, with layers of the electronic panel cut away to illustrate the disposition of circuit completing means, and spacer means (in phantom) disposed atop the pair of electronic switch circuit leads.

Referring now to the drawing and to FIG. 1 in particular, the improved membrane switch of the present invention generally 10 is contained within a switch panel 11 has a top sheet 12 with switch portions 14 designated by visual indicia thereon for manual pushing to operate the switch 10. Such switch panel 11 may have an electronic connecting means in the form preferably of a flexible tail 16.

As shown in FIGS. 2–5, the improved membrane switch 10 of the present invention includes a pair of electronic switch circuit leads 18, 20 which are disposed in noncontacting, and mutually relative proximity. Such switch leads 18, 20 are disposed onto a polymeric sheet 21, which is in turn secured preferably by a contact adhesive 22 to top sheet 12, which contains the visual indicia.

Figure 4:
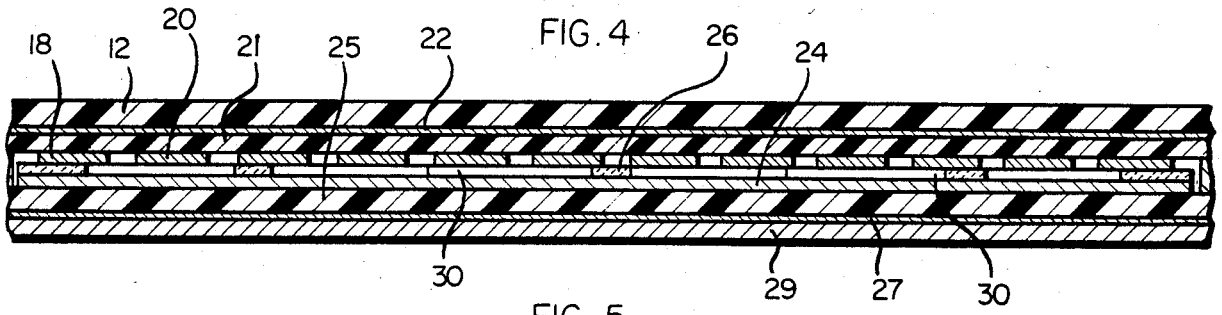
FIG. 4 is an even further enlarged, fragmented side view taken along lines 4—4 of FIG. 3, and illustrating the various layers comprising the improved membrane switch of the present invention.
Figure 5:
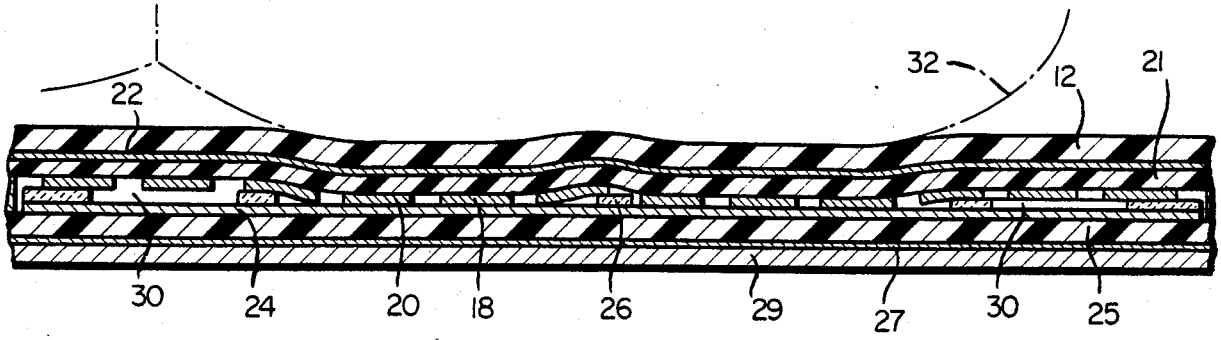
FIG. 5 is the view of the present invention as shown in FIG. 4 showing manual pressure being applied thereto operate the switch.

A substantially planar circuit completing means 24 has a size and shape to correspond with at least a portion of the pair of switch circuit leads 18, 20. Such circuit completing means 24 is formed from a conductive material, and is disposed in spaced array and substantially parallel to the switch circuit leads 18, 20, as shown in FIGS. 4–5. The circuit completing means 24 is disposed on a polymeric sheet 25, which is backed by adhesive 27, which in turn is protected by a peel strip 29 until applied for use to a control panel, etc.

A spacer means 26 of a nonconductive material is disposed between the pair of electronic circuit leads 18, 20, and the circuit completing means 24. Such spacer means 26 may also preferably include a nonconductive border portion 28. The spacer means 26 has a plurality of apertures 30 therein of a selected density sufficient to provide a selective touch pressure for pushing portions of the circuit completing means 24 appearing through the apertures 30 of the spacer means 26 into contact with portions of the pair of electronic switch circuit leads 18, 20 to complete the circuit and to operate switch 10, as shown in FIG. 5 by manual digit 32 lines shown in phantom.

The improved membrane switch of the present invention 10 may specifically include as and for the spacer means 26 the grid formed from lines of a nonconductive material, as shown in the Figures hereof. Of course, spacer means 26 may take shapes and forms other than a grid. Such nonconductive material for spacer means 26 preferably comprises a nonconductive paint, which is disposed on the circuit completing means. Such circuit completing means preferably comprises a conductive paint material.

Figure 8:
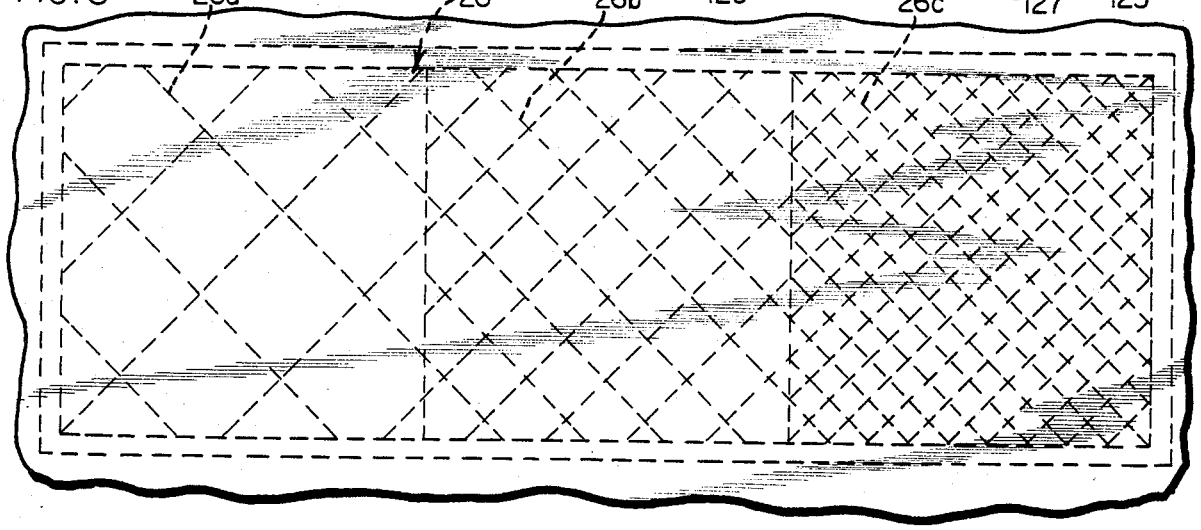
FIG. 8 is a greatly enlarged, and fragmentary top view of the spacer means layer of the improved membrane switch of the present invention illustrating different densities of the grid-like spacer means, which can be utilized in different individual switches, or which may be utilized in different portions of the same switch.

The apertures 30 in spacer means 26 may be selected to have varying density and to be disposed in different portions of the nonconductive spacer means 26, to provide a variable touch pressure at different portions of the nonconductive spacer means 26, as shown for example in FIG. 8. Therein, spacer means generally 26 contains in left-hand portion relatively fewer grid lines **26*a* for lower pressure actuation, the middle portion contains a medium number of grid lines 26*b* for moderate pressure actuation, and the right-hand portion contains a dense number of grid lines 26*c*** for high pressure actuation.

Figure 6:
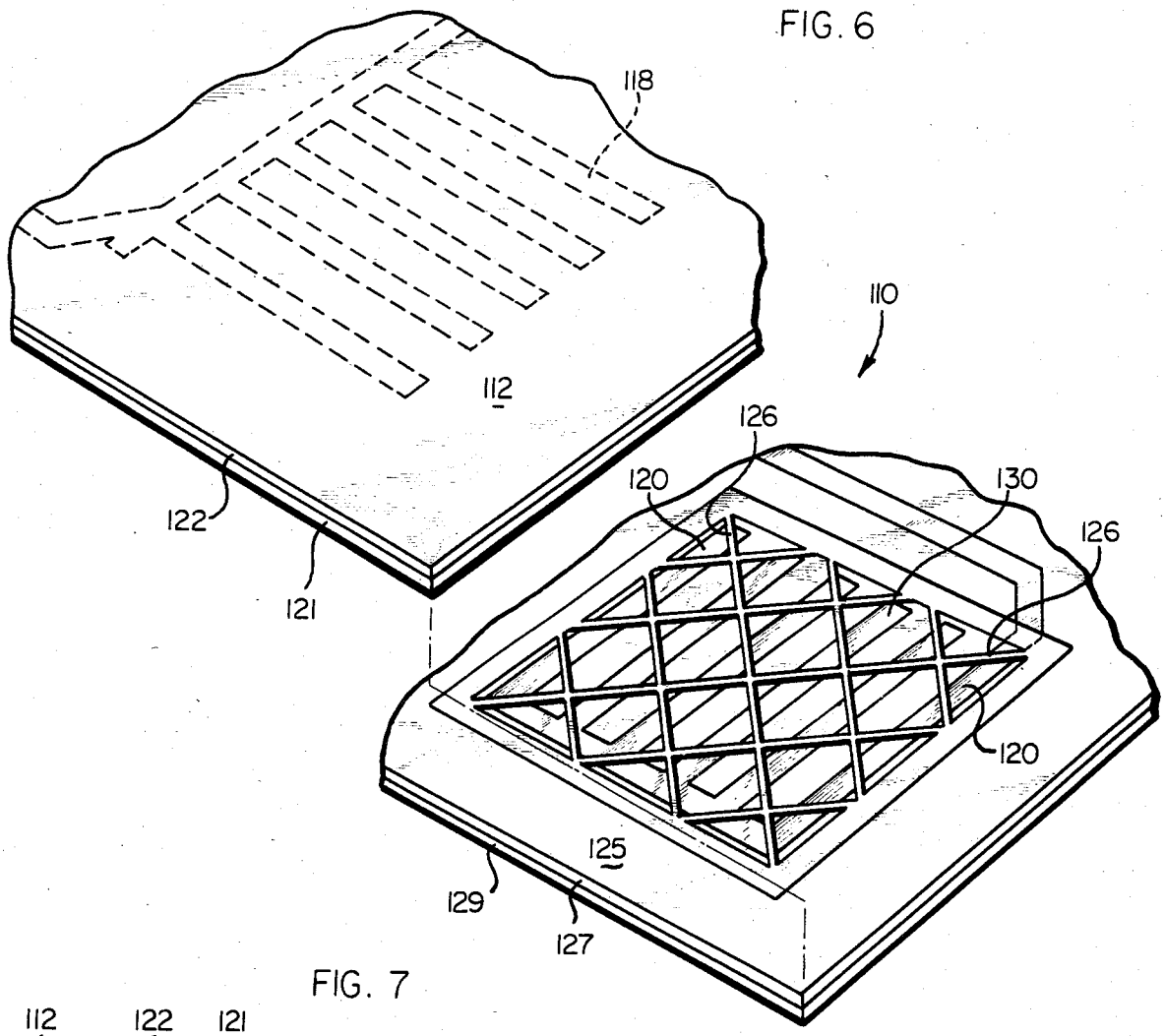
FIG. 6 is an enlarged fragmentary view of an alternative preferred embodiment of the improved membrane switch of the present invention illustrating the electronic switch circuit leads being disposed in separate planes, with the grid-like spacer means of nonconductive material disposed therebetween, such that manual pressure on the switch will contact one electronic lead with the other, and through the apertures in the grid of the spacer means to operate this switch.
Figure 7:
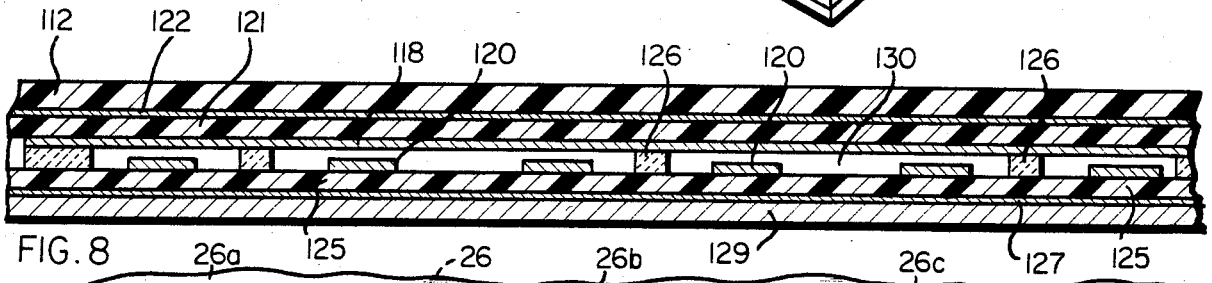
FIG. 7 is a greatly enlarged, and fragmented side view of the alternative preferred embodiment of the improved membrane switch of FIG. 6.

In other preferred embodiments as shown in FIGS. 6–7, generally as switch 110 the electronic switch circuit leads 118, 120 are disposed in separate planes, are disposed substantially parallel to each other and are separated by the spacer means 126. The remaining elements of switch 110 are analogous to those of the first embodiment, switch 10, of FIGS. 2–5, and like elements are designated with like numerals plus 100. In the preferred alternative embodiment of 110, the electronic switch circuit leads 118, 120 are disposed opposite each other and preferably at 90° to each other, whereby sufficient manual pressure on the switch disposes the electronic switch leads 118, 120 into contact through the apertures 130 in spacer means 126 to operate the switch 110.

In the above description, specific details of an embodiment of the invention have been provided for a thorough understanding of the invention concepts. It will be understood by those skilled in the art that many of these details may be varied without departing from the spirit and scope of the invention.

What is claimed is:

1. An improved membrane switch having a top sheet with a portion designated thereon for manual pushing to operate the switch, said switch comprising:

a pair of electronic switch circuit leads disposed in the same plane in noncontacting mutually relative close proximity, said pair of electronic switch circuit leads each comprising a plurality of intertwined but non-contacting elongated bars, said bars having a designated width;

supporting means for said electronic switch circuit leads;

a substantially planar circuit completing means of a size and shape to correspond with at least a portion of said pair of switch circuit leads, formed from conductive material, and disposed in spaced array and substantially parallel to said switch circuit leads; and a nonconductive spacer means comprising a grid, said grid comprising a plurality of substantially intersecting lines of a nonconductive material, said substantially intersecting lines of said grid having a width which is substantially narrow relative to the selected width of said elongated bars of said electronic switch circuit leads, said substantially intersecting lines of said grid disposed directly between said pair of electronic circuit leads and said circuit completing means, said spacer means grid having a plurality of apertures therein formed by said substantially intersecting lines of said grid and having a selected grid density sufficient to provide a selected touch pressure during pushing at least a portion of the said circuit completing means appearing through the apertures in said spacer grid into contact with at least a portion of the pair of electronic switch circuit leads to complete the circuit and to operate the switch.

2. The improved membrane switch of claim 1 wherein said nonconductive material comprises a nonconductive paint.

3. The improved membrane switch of claim 1 wherein said circuit completing means comprises a conductive paint material.

4. The improved membrane switch of claim 3 wherein said conductive paint material is disposed upon a backing sheet.

5. The improved membrane switch of claim 1 wherein said circuit completing means is disposed upon a backing sheet.

6. The improved membrane switch of claim 1 wherein said nonconductive spacer apertures vary in density in different portions of said nonconductive spacer to provide a variable touch pressure at different portions of said nonconductive spacer.

7. The improved membrane switch of claim 1 wherein said pair of electronic switch circuit leads are disposed in a common plane.

8. The improved membrane switch of claim 1 wherein said electronic switch circuit leads are printed of conductive paint.

9. The improved membrane switch of claim 1 wherein the top sheet comprises a nonconductive polymeric overlay containing visual indicia thereon to define the switch portion to be operated by manual pushing.

10. The improved membrane switch of claim 1 wherein said supporting means for said electronic switch circuit leads comprises a substantially planar polymeric sheet.

11. The improved membrane switch of claim 1 wherein said intertwined elongated bars of said electronic switch circuit leads combine to cover a defined area which is substantially co-extensive with a portion designated on the top sheet for manual pushing to operate the switch.

* * * * *